US009020152B2

(12) United States Patent
Swaminathan et al.

(10) Patent No.: US 9,020,152 B2
(45) Date of Patent: Apr. 28, 2015

(54) ENABLING 3D SOUND REPRODUCTION USING A 2D SPEAKER ARRANGEMENT

(75) Inventors: Annamalai Swaminathan, Singapore (SG); Sapna George, Singapore (SG)

(73) Assignee: STMicroelectronics Asia Pacific Pte. Ltd., Singapore (SG)

( * ) Notice: Subject to any disclaimer, the term of this patent is extended or adjusted under 35 U.S.C. 154(b) by 945 days.

(21) Appl. No.: 12/718,277

(22) Filed: Mar. 5, 2010

(65) Prior Publication Data

US 2011/0216906 A1 Sep. 8, 2011

(51) Int. Cl.
*H04R 5/00* (2006.01)

(52) U.S. Cl.
CPC ..... *H04R 5/00* (2013.01)

(58) Field of Classification Search
CPC .... H04R 2217/03; H04R 25/02; H04R 19/04; H04R 1/34; H04R 5/00; H04N 19/00757; H04N 3/08; H04N 5/919; G10H 1/34; G10H 2210/241; G10H 1/00; G10H 1/0008; G10H 2220/131; G10H 2220/206
USPC ..... 381/17–23, 1, 61, 63, 310, 300, 307, 381/97, 150, 387; 700/94; 704/500
See application file for complete search history.

(56) References Cited

U.S. PATENT DOCUMENTS 3,997,725 A * 12/1976 Gerzon ..... 381/21
6,259,795 B1 * 7/2001 McGrath ..... 381/310
7,441,630 B1 * 10/2008 Herrington et al. ..... 181/199

OTHER PUBLICATIONS

Gerzon, M. A., "Psychoacoustic decoders for multispeaker stereo and surround sound," Preprint 3406 of the 93rd Audio Engineering Society Convention, San Francisco, Oct. 1-4, 1992, 47 pages.*

Gerzon, M. A., "Psychoacoustic decoders for multispeaker stereo and surround sound," Preprint 3406 of the 93rd Audio Engineering Society Convention, San Francisco, Oct. 1-4, 1992, 47 pages.

Malham, D. G., "Spatial hearing mechanisms and sound reproduction," 1998, University of York, England, http://www.york.ac.uk/inst/mustech/3d_audio/ambia2.htm, printed on Jan. 8, 2010, 12 pages.

http://en.wikipedia.org/wiki/Ambisonics, printed on Jan. 8, 2010, 13 pages.

http://en.wikipedia.org/wiki/Ambisonic_decoding, printed on Jan. 8, 2010, 3 pages.

* cited by examiner

*Primary Examiner* — Lun-See Lao
(74) *Attorney, Agent, or Firm* — Allen, Dyer, Doppelt, Milbrath & Gilchrist, P.A.

(57) ABSTRACT

The perception of 3D sound positioning can be achieved using a 2D arrangement of speakers positioned around the listener. The disclosed techniques can enable listeners to perceive sounds as coming from above and/or below them, without the need for positioning speakers above and/or below the listener. In some embodiments, elevation information can be included in the X and Y horizontal components of the 2D ambisonics encoding. The X and Y components can be decoded using 2D ambisonics decoding. Suitable filtering may be performed on the decoded sound information to enhance the listener's perception of the elevation information encoded in the X and Y components.

29 Claims, 8 Drawing Sheets

ENABLING 3D SOUND REPRODUCTION USING A 2D SPEAKER ARRANGEMENT

BACKGROUND

1. Technical Field

The techniques described herein relate generally to audio signal processing and reproduction, and in particular to directional encoding and decoding enabling reproduction of sounds positioned in three-dimensional (3D) space using a two-dimensional (2D) arrangement of speakers.

2. Discussion of the Related Art

Various techniques exist for reproducing sound in a manner that conveys directional information about the position from which the sound originates with respect to a listener. Some techniques attempt to reproduce sounds for a listener in a manner that can simulate sound originating at any point in 3D space. As a result, the listener may perceive sound as coming from one or more selected positions in 3D space, such as above, below, in front of, behind or to the side of the listener. Some techniques use speakers positioned around the listener and above and below the listener to achieve the desired sound positioning effect.

Several conventional techniques for 3D positioning and reproducing of sounds exist, including: 1) binaural synthesis using head-related transfer function (HRTF) based transaural methods; 2) amplitude panning and equalization filters; and 3) ambisonics encoding and decoding.

Conventional binaural techniques can provide 3D audio reproduction using the HRTF and crosstalk cancellation method. However, conventional binaural techniques have certain drawbacks. Binaural methods are computationally demanding, and may require significant computing power. HRTFs can only be measured at a set of discrete positions around the head. Designing a binaural system which can faithfully reproduce sounds from all directions can be highly challenging and require significant computing power. The sound perceived is highly dependant on the shape of the head, pinnae and torso of the listener. If the listener's head, pinnae and torso are not identical to the dummy head used for the HRTF, the fidelity of reproduction can be compromised. In addition, binaural techniques can be highly sensitive to the position of the listener, and may only provide suitable performance at one position (known as a "sweet spot") due to the positional dependency of crosstalk cancellation.

Amplitude panning and equalization filters can position a sound in a multichannel playback system by weighting an audio input signal using a set of amplifiers that feeds loudspeakers individually. Equalization filters are used to virtually position a sound in the vertical plane. These techniques may provide for 3D audio reproduction, but have certain drawbacks. For example, they may have difficulty providing good localization in the center front of the speaker system. They can also be position dependent and sensitive to the sweet spot. They can require position dependent amplitude selection for each channel and elevation dependant equalization filtering that can be computationally demanding. Another drawback is that the speaker positions need to be known at the encoder phase itself. This constrains the end user as the speaker setup is not configurable after encoding. Another disadvantage is that a large number of channels may be required to faithfully reproduce sounds from all directions.

Ambisonics first order encoding and decoding, also known as B-format encoding and decoding, is widely accepted as a very efficient way of positioning sounds in 3D space. Ambisonics has quite a few advantages over the other two approaches. For example, it is computationally less demanding. The speaker layout does not need to be known at the encoder phase and the encoded signal can work with a variety of speaker array configurations. Conventional ambisonics needs only 3 channels (WXY) for reproduction of planar (2D) sounds and 4 channels (WXYZ) for reproduction of full sphere (3D) sounds. Ambisonics can provide good localization at any position around the listener. Ambisonics is also independent of the listener's features (head, pinnae, torso), and can be less sensitive to the position of the listener. All of the speakers can be used for reproducing a sound, and hence sound positioning can be more accurate.

There are two types of conventional first order ambisonics:

| Ambisonics soundfield type | Horizontal order | Vertical order | Number of channels | Channels |
|---|---|---|---|---|
| Horizontal/2D/planar | 1 | 0 | 3 | WXY |
| Full-sphere/3D/periphonic | 1 | 1 | 4 | WXYZ |

Planar ambisonics (also called horizontal or 2D ambisonics) is designed for playback of 2D sound using a 2D arrangement of speakers. Full sphere ambisonics (also called 3D or periphonic ambisonics) is designed for playback of 3D sound using a 3D arrangement of speakers. One problem with full sphere ambisonics is that it can be difficult to achieve a suitable 3D arrangement of speakers in the home or similar environments. It can be difficult to mount and wire speakers in suitable positions above the listener's head to achieve the desired 3D sound effect, and a specialized speaker installation may be required.

SUMMARY

Some embodiments relate to a method of processing sound information. The sound information represents a position of a sound relative to an x-axis, a y-axis perpendicular to the x-axis, and a z-axis perpendicular to the x-axis and the y-axis. X encoding information is received representing a position component of the sound along the x-axis. The X encoding information includes information related to a position of the sound along the z-axis. Y encoding information is received representing a position component of the sound along the y-axis. The Y encoding information includes information related to a position of the sound along the z-axis. First filtering of the sound information is performed when the position of the sound is above a first position along the z-axis. Second filtering of the sound information is performed when the position of the sound is below the first position along the z-axis. Some embodiments relate to a system for processing the sound information.

Some embodiments relate to a method of processing sound information representing a position of a sound. Ambisonics X and Y components are received which comprise elevation information. The ambisonics X and Y components are decoded into signals suitable for reproducing 3D sound using a 2D arrangement of speakers.

This summary is presented by way of illustration and is not intended to be limiting.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

BRIEF DESCRIPTION OF DRAWINGS

In the drawings, each identical or nearly identical component that is illustrated in various figures is represented by a like reference character. For purposes of clarity, not every component may be labeled in every drawing.

DETAILED DESCRIPTION

In accordance with the inventive techniques described herein, the perception of 3D sound positioning can be achieved using a 2D arrangement of speakers positioned around the listener. Advantageously, these techniques can enable listeners to perceive sounds as coming from above and/or below them, without the need for positioning speakers above and/or below the listener.

Some embodiments make use of a modification of conventional first order ambisonics techniques for encoding and decoding sound positional information. Conventional 2D ambisonics encoding does not include elevation information, as conventional 2D ambisonics is designed for encoding and decoding sound information for playback using a 2D arrangement of speakers. In some embodiments, elevation information can be included in the X and Y horizontal components of the ambisonics encoding. The X and Y components can then be decoded using 2D ambisonics decoding. Suitable filtering may be performed on the decoded sound information to enhance the listener's perception of the elevation information encoded in the X and Y components. Playing back the filtered sound information using a 2D arrangement of speakers can produce the perception of 3D sound positioning.

Discussion of Ambisonics

Figure 1:
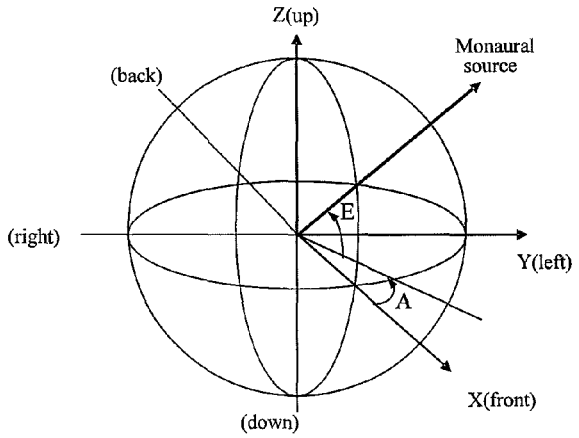
FIG. 1 shows a diagram of a unit sphere and a coordinate system.

FIG. 1 shows a diagram of a unit sphere and a coordinate system having three axes: an x-axis, a y-axis and a z-axis. Using conventional 3D ambisonics techniques, sound can be reproduced by a 3D arrangement of speakers such that the listener perceives the sound as coming from a selected position in 3D space. The position from which the sound is perceived to originate can be represented by the coordinates of a point in 3D space. The point may be inside of, on, or outside of the unit sphere shown in FIG. 1. According to the exemplary coordinate system shown in FIG. 1, the positive x direction is the direction extending in front of the listener and the negative x direction is the direction extending to the back of the listener. The positive y direction is the direction to the left of the listener and the negative y direction is the direction to the right of the listener. The positive z direction is the direction above the listener and the negative z direction is the direction below the listener. The x-y plane will also be referred to herein as the horizontal plane, as it can represent the plane parallel to the ground. The angle E is the angle of elevation from the x-y horizontal plane to the selected position of the sound in 3D space. The angle A is the azimuthal angle that extends counterclockwise around the listener from the positive x-axis to the selected position of the sound in 3D space. The angles E and A are angles in spherical polar coordinates conventionally used for encoding position information in 3D ambisonics format.

The coordinate system for conventional 2D ambisonics is the same as that discussed above for 3D ambisonics, with the exception that height information (z dimension) is not included in 2D ambisonics encoding. 2D ambisonics uses a three channel encoding that includes omnidirectional sound information and positional sound information in the x-y horizontal plane.

The encoding equations for first order 2D ambisonics are:

$$W=\text{input signal}*0.707;$$

$$X_{2D}=\text{input signal}*\cos A;\ \text{and}$$

$$Y_{2D}=\text{input signal}*\sin A;$$

where W is the omnidirectional component of the sound, $X_{2D}$ is the front-back positional component of the sound, $Y_{2D}$ is the left-right positional component of the sound and A is the azimuthal angle that extends counterclockwise around the listener from the positive x-axis to the selected position of the sound in 2D space.

Figure 2:
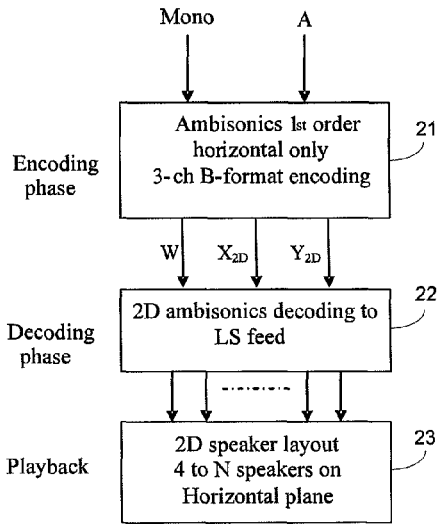
FIG. 2 shows a flow diagram of a technique for processing a signal in 2D ambisonics format.

FIG. 2 shows a flow diagram of a technique for encoding and reproducing sound in 2D ambisonics format. In step 21, the 2D ambisonics components W, $X_{2D}$, and $Y_{2D}$ are encoded using the 2D ambisonics encoding equations shown above. The ambisonics components may be decoded in step 22. For example, the ambisonics components may be decoded by an audio receiver that drives a speaker arrangement for playback of the sound. In step 22, the decoder can decode the signals for driving various speakers using the 2D ambisonics decoding equation:

$$LS=\text{sqrt}(2)*W+\cos(A_s)*X_{2D}\sin(A_s)*Y_{2D},$$

where $A_s$ is the azimuthal angle of the position of the individual speakers. The decoding equation may be used to obtain the driving signal applied to each speaker at their respective azimuthal position $A_s$. In step 23, the driving signals can be provided to the individual speakers so that speakers play back the sound for the listener. In conventional 2D ambisonics, the decoding is designed for speakers positioned in a 2D plane around the listener.

Figure 3:
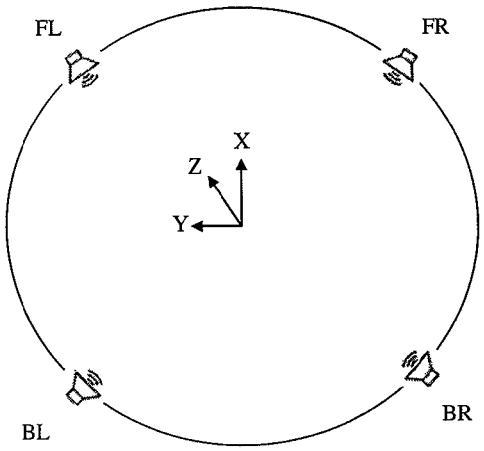
FIG. 3 shows a square arrangement of four speakers.

FIG. 3 shows a square arrangement of speakers that may be used to reproduce sound using ambisonics techniques. Using a square speaker configuration, the four speakers may be positioned to the front left, front right, back left and back right of the listener. The four speakers may be positioned at the corners of a square surrounding the listener in the horizontal plane, with the speakers having respective azimuthal angle positions of 45°, 135°, 225°, and 315°. Other suitable 2D speaker arrangements may be used, including those shaped like other types of regular or irregular polygons.

Figure 4:
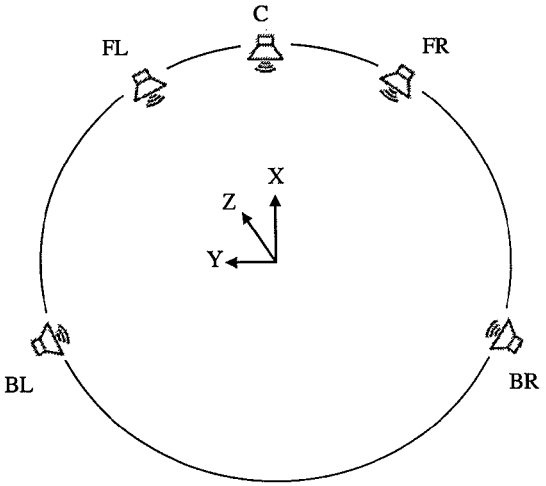
FIG. 4 shows an arrangement of five speakers positioned in accordance with ITU. 5.1.

FIG. 4 shows another 2D speaker arrangement having five speakers positioned in accordance with ITU 5.1. FIG. 4 shows that the speakers are positioned at 0, ±30, and ±110 degrees with front left (FL), center (C), front right (FR), back left (BL), back right (BR) speakers. The speaker arrangements shown in FIGS. 3 and 4 can be used for playback of sound using conventional 2D ambisonics techniques or in accordance with the embodiments described below.

Figure 5:
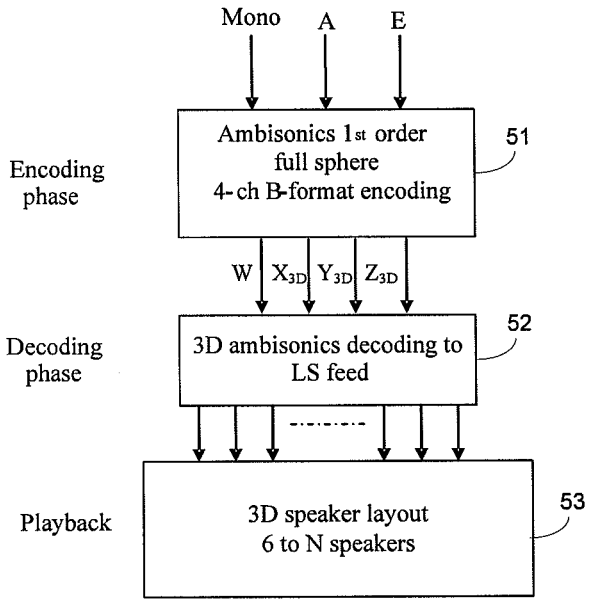
FIG. 5 shows a flow diagram of a technique for encoding and reproducing a signal in 3D ambisonics format.

Conventionally, a 3D speaker arrangement and 3D encoding is used for encoding and reproducing 3D sound using ambisonics. FIG. 5 shows a flow diagram of a technique for encoding and reproducing sound using 3D ambisonics. The encoding equations for conventional 3D ambisonics are:

$$W=\text{input signal}*0.707;$$

$$X_{3D}=\text{input signal}*\text{Cos } A*\text{Cos } E;$$

$$Y_{3D}=\text{input signal}*\text{Sin } A*\text{Cos } E; \text{ and}$$

$$Z_{3D}=\text{input signal}*\text{Sin } E;$$

where $Z_{3D}$ is the up-down positional component, $X_{3D}$ is the front-back positional component, $Y_{3D}$ is the left-right positional component, E is the angle of elevation of the sound source above the x-y plane and A is the azimuthal angle that extends counterclockwise around the listener to the selected position of the sound in 3D space. In step 51, the 3D ambisonics components W, $X_{3D}$, $Y_{3D}$, and $Z_{3D}$ are encoded using the 3D ambisonics encoding equations shown above. The 3D ambisonics components may be decoded in step 52. For example, the ambisonics components may be decoded by an audio receiver that drives a speaker arrangement for playback of the sound. In step 52, the decoder can decode the ambisonics components for driving various speakers using the 3D ambisonics decoding equation:

$$LS=\text{sqrt}(2)*W+\cos A_s*\cos E_s*X_{3D}+\sin A_s*\cos E_s*Y_{3D}+\sin E_s*Z_{3D}$$

where $A_s$ is the azimuthal angle of the position of a speaker and $E_s$ is the elevation angle of the position of the speaker. The 3D decoding equation may be used to obtain the driving signal applied to each speaker at their respective azimuthal position $A_s$ and elevation angle $E_s$. In step 53, the driving signals can be provided to the individual speakers so they play back the sound for the listener. In conventional 3D ambisonics, the speakers are positioned in a 3D configuration with speakers positioned above and below the listener.

Figure 6:
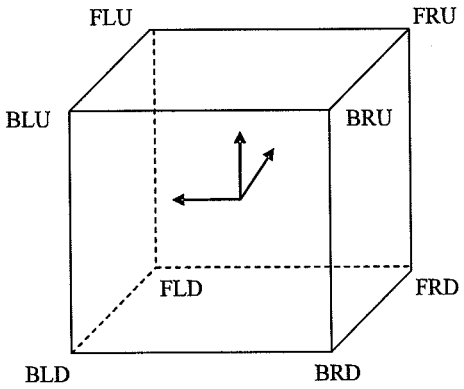
FIG. 6 shows a 3D speaker arrangement in which eight speakers are positioned at the corners of a cube.

FIG. 6 shows a 3D speaker arrangement in which eight speakers are positioned at the corners of a cube. Speakers are positioned at the upper front left, the upper front right, the lower front left, the lower front right, the upper back left, the upper back right, the lower back left and the lower back right of the listener. Other 3D speaker configurations may be used, such as an octahedron or birectangular speaker setup, which may require at least six speakers. However, as discussed above, it may be difficult to install the speakers in a suitable 3D configuration in the home or other environments.

Providing 3D Sound Using a 2D Speaker Arrangement

In accordance with some embodiments, 3D sound can be encoded using ambisonics techniques and reproduced for a listener using a 2D speaker arrangement. Applicants have recognized and appreciated that the $X_{3D}$ and $Y_{3D}$ components of the 3D ambisonics encoding include elevation information. The elevation information contained in the $X_{3D}$ and $Y_{3D}$ components enable providing the listener with the perception of sound positioned in 3D space using a 2D arrangement of speakers.

Figure 7:
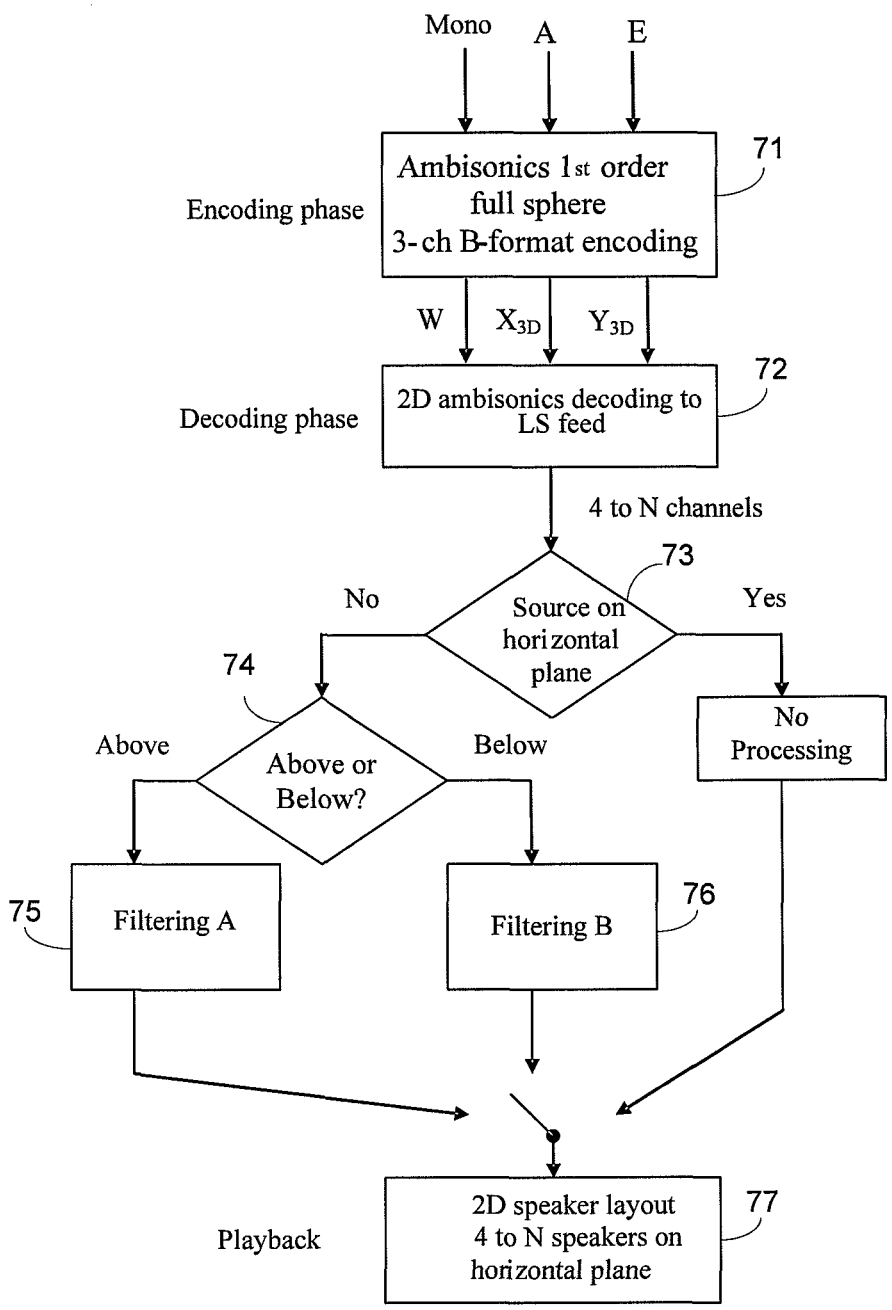
FIG. 7 shows a flow diagram of a technique for encoding and decoding sound information enabling 3D sound reproduction using a 2D speaker arrangement, in accordance with some embodiments.

FIG. 7 shows a flow diagram of a technique for encoding and reproducing a signal such that 3D sound positioning can be achieved using a 2D speaker arrangement. In step 71, the ambisonics signals W, $X_{3D}$, and $Y_{3D}$ may be encoded using the following equations:

$$W=\text{input signal}*0.707;$$

$$X_{3D}=\text{input signal}*\text{Cos } A*\text{Cos } E; \text{ and}$$

$$Y_{3D} \text{ input signal}*\text{Sin } A*\text{Cos } E;$$

The $X_{3D}$ and $Y_{3D}$ components differ from conventional 2D components $X_{2D}$ and $Y_{2D}$ due to the presence of the Cos E term. The Cos E term provides elevation information that is encoded in the $X_{3D}$ and $Y_{3D}$ components. The $Z_{3D}$ elevation component of conventional 3D ambisonics may not be used in a 2D speaker arrangement because the 2D decoding is designed for speakers arranged on the horizontal plane. Thus, the $Z_{3D}$ component of conventional 3D ambisonics need not be encoded. A single monaural sound source or multiple monaural sound sources may be positioned for the listener in 3D space. In some embodiments, the ambisonics components may represent audio recorded using a microphone The ambisonics component signals W, $X_{3D}$, and $Y_{3D}$ may be decoded in step 72. For example, the ambisonics signals may be decoded by an audio receiver that drives a speaker arrangement for playback of the sound. In step 72, the decoder may decode the signals for driving various speakers using the equation:

$$LS=0.5*(\text{sqrt}(2)W+\cos(As)*X_{3D}+\sin(As)*Y_{3D}).$$

Figure 11:
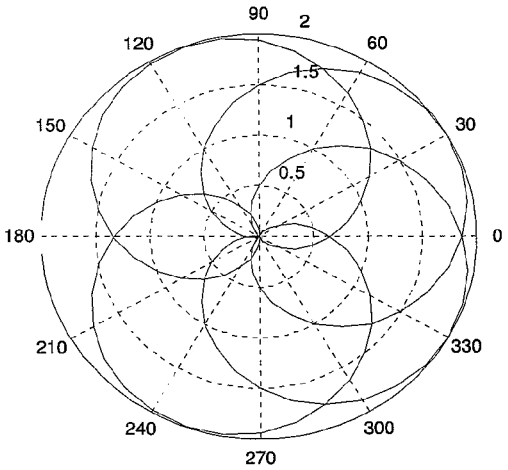
FIG. 11 shows a polar plot of sound reproduction using an ITU 5.1 speaker setup without normalization.
Figure 12:
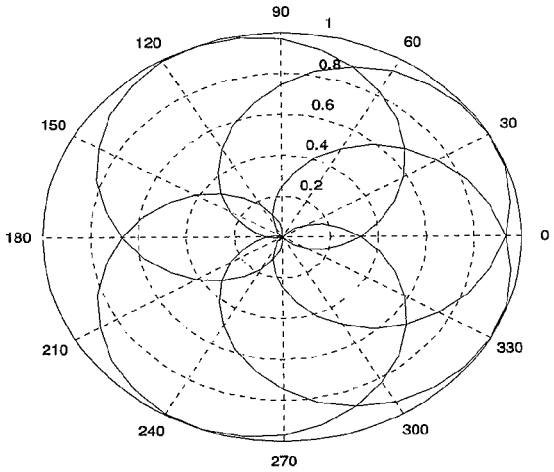
FIG. 12 shows a polar plot of sound reproduction using an ITU 5.1 speaker setup with normalization.
Figure 13:
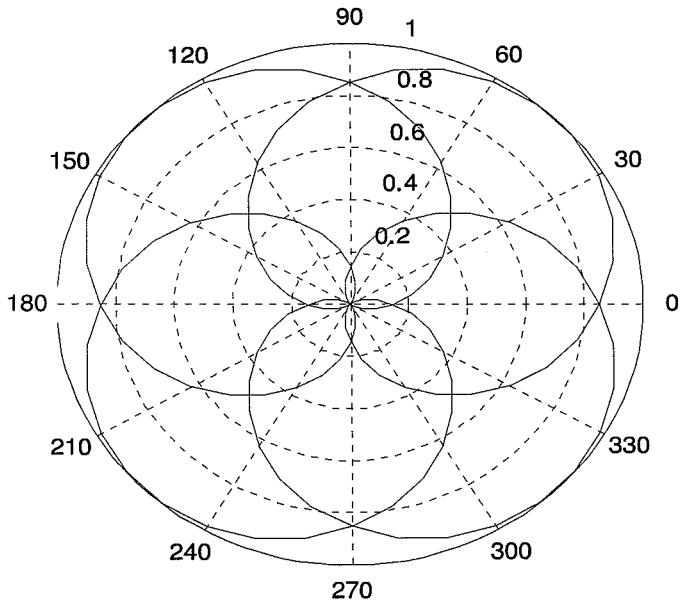
FIG. 13 shows a polar plot of sound reproduction using a square speaker setup with normalization.

Since the overall gain doubles at the speaker location, a normalization gain of 0.5 can be added to the decoding equation (as shown above) to maintain the gain of the input signal at the speaker stage. The polar plot for this pair of encoding/decoding equations and an ITU 5.1 speaker setup with the center channel silenced is shown in FIG. 11. From the polar plot, it can be seen that the overall gain doubles at the speaker location. Hence a normalization gain of 0.5 was added to the decoder equation. The decoding equation may be similar to the conventional 2D ambisonics decoding equation with a normalization by 0.5. The polar plot after gain normalization for the ITU 5.1 and square speaker setups are shown in FIGS. 12 and 13 respectively.

In step 73, a determination may be made as to whether the sound source is positioned on the horizontal x-y plane (e.g., E=0). If so, no further processing may be needed, and the decoded signals may be provided to the individual speakers for playback in step 77. If the sound source does not lie on the horizontal plane, further processing may be performed to enhance the perception of the elevation information included in the $X_{3D}$, and $Y_{3D}$ components.

In step 74, a determination may be made as to whether the sound source is positioned above or below the horizontal x-y plane. Different processing may be performed depending on whether the sound source lies above or below the x-y plane. For example, if the sound source is positioned above the horizontal x-y plane (e.g., E>0), the decoded signals may be high-pass filtered. If the sound source lies below the horizontal x-y plane (e.g., E<0), the decoded signals may be low-pass filtered. Performing different filtering for sounds positioned at different heights can enable the listener to perceive sounds as originating in 3D space. Any type of sound source may be used, including full bandwidth or band-limited signals, with any suitable sampling frequency.

The accuracy of positioning provided can be better than amplitude panning techniques. Automatic gain balancing may be performed between the channels, which may provide for reduced cost compared to manual gain manipulation that depends on the position of the source. Sound can be positioned at any distance from the listener, as controlled by an attenuation factor in the decoding phase. Blind tests were conducted with a moving sound input and the listeners were able to perceive the sound movement in the correct direction.

Figure 8:
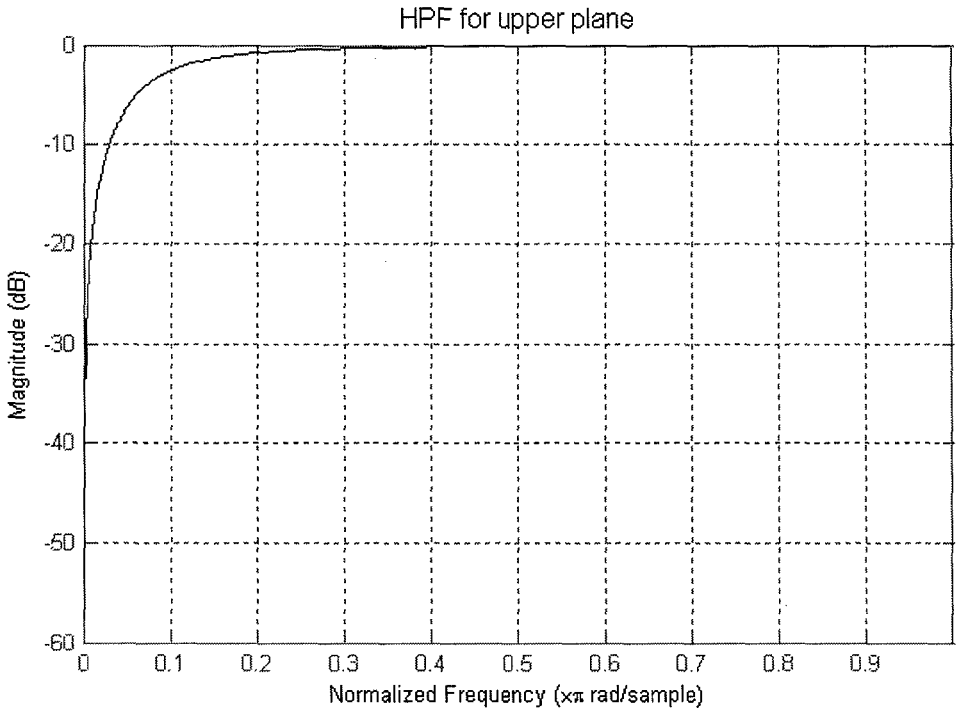
FIG. 8 shows the frequency response of a high pass filter that may be used for filtering sounds above the x-y plane, according to some embodiments.
Figure 9:
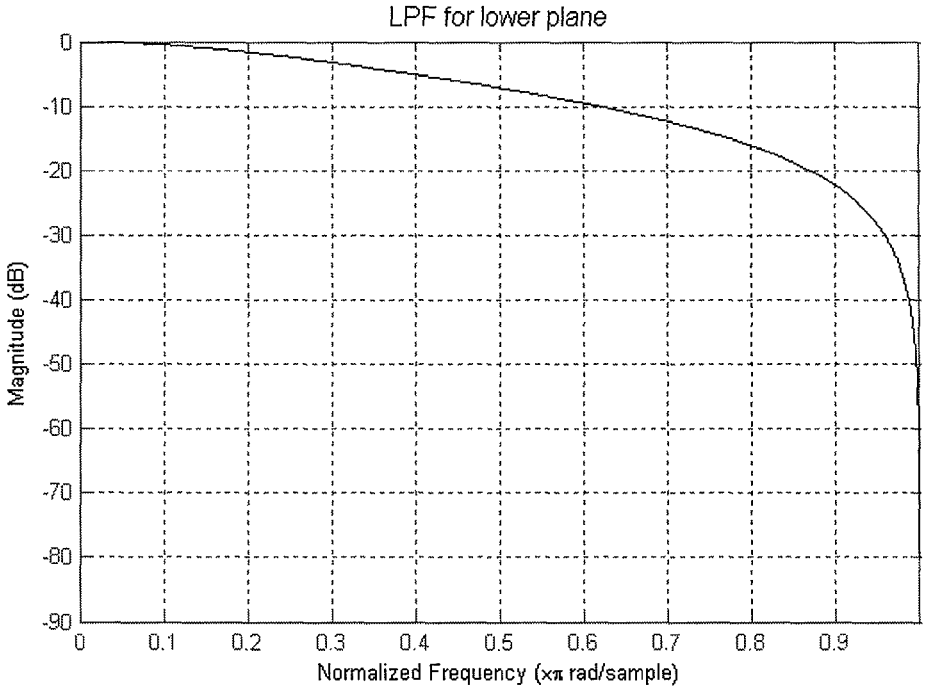
FIG. 9 shows the frequency response of a low pass filter that may be used for filtering sounds below the x-y plane, according to some embodiments.

In some embodiments, the filters that filter the sound may be first order digital infinite impulse response (IIR) filters that advantageously do not require significant computation. The applied filtering technique can be simple, efficient and cost-effective. FIG. 8 shows the magnitude frequency response of a high pass filter that may be used for filtering sounds originating above the x-y plane, according to some embodiments. FIG. 9 shows the magnitude frequency response of a low pass filter that may be used for filtering sounds below the x-y plane, according to some embodiments. However, any suitable filters may be used, as the techniques described herein are not limited to particular filter implementations. Filtering may be configured dynamically based on the sampling frequency of the input signal.

Figure 10:
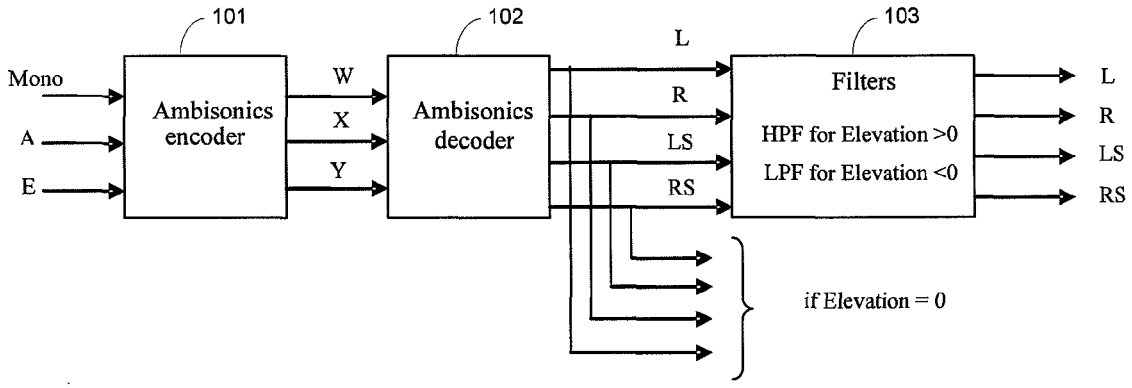
FIG. 10 shows a block diagram of a system for encoding and decoding sound information enabling 3D sound reproduction using a 2D speaker arrangement, in accordance with some embodiments.

FIG. 10 shows a block diagram system for processing sound signals, according to some embodiments. The system may include an encoder 101 configured to encode sound into ambisonics components W, $X_{3D}$ and $Y_{3D}$, according to the techniques described herein. The system may include a decoder 102 configured to decode ambisonics components W, $X_{3D}$ and $Y_{3D}$ into 2D components/signals for reproduction by a speaker arrangement, as discussed above. Any suitable speaker arrangement may be used, such as the speaker arrangements shown in FIGS. 3 and 4, for example. Any suitable number of speakers may be used. Theoretically, three or more speakers should be used to provide good sound localization. Using four or more speakers may be preferred to provide improved sound positioning. For example, at least one speaker may be positioned in each quadrant around the listener, wherein each of the quadrants is non-overlapping and spans 90°. If four speakers are used, for example, the decoder 102 may produce decoded signals (e.g., L, R, LS and RS) for each of the speakers. However, any suitable speaker configuration may be used. If the number of speakers around the listener is increased, the positioning becomes more accurate, but to ideally reproduce a sound positioned in 3D space an infinite number of speakers is required. Hence, for practical purposes, these techniques were tested with the most commonly used speaker setups like a square layout and an ITU 5.1 layout with a minimal number of speakers around the listener. Since four channels are sufficient, the center channel and LFE can be silenced in the case of ITU 5.1 and thereby save processing. In a case where the center channel and LFE cannot be silenced, a very small multiple (0.05~0.1) of the omni-directional signal W can be fed into the center channel and LFE, without a detrimental effect on the sound positioning. Although the techniques described herein are capable of reproducing 3D sound using a 2D arrangement of speakers arranged in a plane, the speakers need not be positioned precisely in a plane for suitable operation.

The system may include a filter unit 103 that may filter the decoded signals to enable the listener to perceive sounds positioned in 3D space. For example, as discussed above, when the sound source is positioned above the x-y plane the signals may be filtered using a high pass filter. When the sound source is below the x-y plane the signals may be filtered using a low pass filter. The filtered speaker signals may then be provided to the speakers for playback.

The above-described embodiments of the present invention and others can be implemented in any of numerous ways. For example, an encoder, decoder, and/or filter and other components may be implemented using hardware, software or a combination thereof. When implemented in hardware, any suitable audio processing hardware may be used, such as general-purpose or application-specific audio processing hardware for encoding ambisonics components, decoding ambisonics components, and/or performing filtering. When implemented in software, the software code can be executed on any suitable hardware processor or collection of hardware processors, whether provided in a single computer or distributed among multiple computers.

Some embodiments include at least one tangible computer-readable storage medium (e.g., a computer memory, a floppy disk, a compact disk, a tape, etc.) encoded with a computer program (i.e., a plurality of instructions), which, when executed on a processor, perform the above-discussed functions. In addition, it should be appreciated that the reference to a computer program which, when executed, performs the above-discussed functions, is not limited to an application program running on a host computer. Rather, the term computer program is used herein in a generic sense to reference any type of computer code (e.g., software or microcode) that can be employed to program a processor to implement the above-discussed aspects of the techniques described herein.

This invention is not limited in its application to the details of construction and the arrangement of components set forth in the foregoing description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A method of processing sound information representing a position of a sound relative to an x-axis, a y-axis perpendicular to the x-axis, and a z-axis perpendicular to the x-axis and the y-axis, the method comprising:

using a decoder for receiving X encoding information representing a position component of the sound along the x-axis, wherein the X encoding information includes information related to a position of the sound along the z-axis;

using the decoder for receiving Y encoding information representing a position component of the sound along the y-axis, wherein the Y encoding information includes information related to a position of the sound along the z-axis;

using a high pass filter for high pass filtering the sound information when the position of the sound is above a first position along the z-axis; and using a low pass filter for low pass filtering the sound information when the position of the sound is below the first position along the z-axis.

2. The method of claim 1, wherein the first high pass filtering is performed when the position of the sound is above a horizontal plane formed by the x-axis and the y-axis and the low pass filtering is performed when the position of the sound is below the horizontal plane.

3. The method of claim 1, wherein the X encoding information and the Y encoding information are 3D ambisonics components.

4. The method of claim 1, further comprising:

decoding the X and Y encoding information to produce decoded sound information.

5. The method of claim 4, wherein the X and Y encoding information is decoded for playback by a 2D speaker arrangement.

6. The method of claim 4, wherein the high pass filtering and/or the low pass filtering of the sound information is performed on the decoded sound information.

7. The method of claim 1, further comprising reproducing the sound for a listener such that the listener perceives 3D sound.

8. The method of claim 1, wherein the sound is reproduced using a first speaker positioned in a first quadrant, a second speaker positioned in a second quadrant, a third speaker positioned in a third quadrant, and a fourth speaker positioned in a fourth quadrant, the first, second, third and fourth quadrants being around the listener.

9. A system for processing sound information representing a position of a sound relative to an x-axis, a y-axis perpendicular to the x-axis, and a z-axis perpendicular to the x-axis and the y-axis, the system comprising:

a decoder configured to receive X encoding information representing a position component of the sound along the x-axis, wherein the X encoding information includes information related to a position of the sound along the z-axis, and receive Y encoding information representing a position component of the sound along the y-axis, wherein the Y encoding information includes information related to a position of the sound along the z-axis;

a high pass filter configured to high pass filter the sound information when the position of the sound is above a first position along the z-axis; and a low pass filter configured to low pass filter the sound information when the position of the sound is below the first position along the z-axis.

10. The system of claim 9, wherein the high pass filtering is performed when the position of the sound is above a horizontal plane formed by the x-axis and the y-axis and the low pass filtering is performed when the position of the sound is below the horizontal plane.

11. The system of claim 9, wherein the decoder is configured to decode the X and Y encoding information to produce decoded sound information.

12. The system of claim 11, wherein the decoder is configured to decode the X and Y encoding information into signals suitable for playback by a 2D speaker arrangement.

13. A method of processing sound information representing a position of a sound relative to an x-axis, a y-axis perpendicular to the x-axis, and a z-axis perpendicular to the x-axis and the y-axis, the method comprising:

using a decoder for receiving X encoding information representing a position component of the sound along the x-axis, wherein the X encoding information includes information related to a position of the sound along the z-axis; using the decoder for receiving Y encoding information representing a position component of the sound along the y-axis, wherein the Y encoding information includes information related to a position of the sound along the z-axis; and using a high pass filter for high pass filtering the sound information to de-emphasize low frequency components of the sound information when the position of the sound is above a first position along the z-axis, and using a low pass filter for low pass filtering the sound information to de-emphasize high frequency components of the sound information when the position of the sound is below the first position along the z-axis.

14. The method of claim 13, wherein the X encoding information and the Y encoding information are 3D ambisonics components.

15. The method of claim 13, further comprising:

decoding the X and Y encoding information to produce decoded sound information.

16. The method of claim 15, wherein the X and Y encoding information is decoded for playback by a 2D speaker arrangement.

17. The method of claim 13, further comprising reproducing the sound for a listener such that the listener perceives 3D sound.

18. A system for processing sound information representing a position of a sound relative to an x-axis, a y-axis perpendicular to the x-axis, and a z-axis perpendicular to the x-axis and the y-axis, the system comprising:

a decoder configured to receive X encoding information representing a position component of the sound along the x-axis, wherein the X encoding information includes information related to a position of the sound along the z-axis, and receive Y encoding information representing a position component of the sound along the y-axis, wherein the Y encoding information includes information related to a position of the sound along the z-axis; and a processor configured to high pass filter the sound information to de-emphasize low frequency components of the sound information when the position of the sound is above a first position along the z-axis and low pass filter the sound information to de-emphasize high frequency components of the sound information when the position of the sound is below the first position along the z-axis.

19. The system of claim 18, wherein the decoder is configured to decode the X and Y encoding information to produce decoded sound information.

20. The system of claim 19, wherein the decoder is configured to decode the X and Y encoding information into signals suitable for playback by a 2D speaker arrangement.

21. A computer readable storage medium having stored thereon instructions, which, when executed by a processor, perform a method of processing sound information representing a position of a sound relative to an x-axis, a y-axis perpendicular to the x-axis, and a z-axis perpendicular to the x-axis and the y-axis, the method comprising:

using the processor for receiving X encoding information representing a position component of the sound along the x-axis, wherein the X encoding information includes information related to a position of the sound along the z-axis;

using the processor for receiving Y encoding information representing a position component of the sound along the y-axis, wherein the Y encoding information includes information related to a position of the sound along the z-axis;

using the processor for high pass filtering the sound information when the position of the sound is above a first position along the z-axis; and using the processor for low pass filtering the sound information when the position of the sound is below the first position along the z-axis.

22. The computer readable storage medium of claim 21, wherein the high pass filtering is performed when the position of the sound is above a horizontal plane formed by the x-axis and the y-axis and the low pass filtering is performed when the position of the sound is below the horizontal plane.

23. The computer readable storage medium of claim 21, wherein the X encoding information and the I encoding information are 3D ambisonics components.

24. The computer readable storage medium of claim 21, wherein the method further comprises decoding the X and Y encoding information to produce decoded sound information.

25. The computer readable storage medium of claim 24, wherein the X and Y encoding information is decoded for playback by a 2D speaker arrangement.

26. The computer readable storage medium of claim 25, wherein at least one of the high pass filtering and the low pass filtering of the sound information is performed on the decoded sound information.

27. A computer readable storage medium having stored thereon instructions, which, when executed by a processor, perform a method of processing sound information representing a position of a sound relative to an x-axis, a y-axis perpendicular to the x-axis, and a z-axis perpendicular to the x-axis and the y-axis, the method comprising:

using the processor for receiving X encoding information representing a position component of the sound along the x-axis, wherein the X encoding information includes information related to a position of the sound along the z-axis; using the processor for receiving Y encoding information representing a position component of the sound along the y-axis, wherein the Y encoding information includes information related to a position of the sound along the z-axis; and using the processor for high pass filtering the sound information to de-emphasize low frequency components of the sound information when the position of the sound is above a first position along the z-axis and for low pass filtering the sound information to de-emphasize high frequency components of the sound information when the position of the sound is below the first position along the z-axis.

28. The computer readable storage medium of claim 27, wherein the X encoding information and the Y encoding information are 3D ambisonics components.

29. The computer readable storage medium of claim 27, wherein the method further comprises decoding the X and Y encoding information to produce decoded sound information.

* * * * *

UNITED STATES PATENT AND TRADEMARK OFFICE

CERTIFICATE OF CORRECTION

PATENT NO. : 9,020,152 B2
APPLICATION NO. : 12/718277
DATED : April 28, 2015
INVENTOR(S) : Swamininathan et al.

It is certified that error appears in the above-identified patent and that said Letters Patent is hereby corrected as shown below:

In the claims

Column 11, Line 13 Delete: "I"
Insert: --Y--

Signed and Sealed this
Third Day of November, 2015

Michelle K. Lee

Michelle K. Lee
*Director of the United States Patent and Trademark Office*